US007256533B2

(12) United States Patent
Landon, Jr.

(10) Patent No.: US 7,256,533 B2
(45) Date of Patent: Aug. 14, 2007

(54) HIGH ELECTRICAL STICTION SPARK PLUG

(76) Inventor: William W. Landon, Jr., 18 Craigemore Cir., Avon, CT (US) 06001

( * ) Notice: Subject to any disclaimer, the term of this patent is extended or adjusted under 35 U.S.C. 154(b) by 533 days.

(21) Appl. No.: 10/899,665

(22) Filed: Jul. 27, 2004

(65) Prior Publication Data

US 2006/0022565 A1 Feb. 2, 2006

(51) Int. Cl.
*H01T 13/20* (2006.01)
*H01T 13/32* (2006.01)

(52) U.S. Cl. ..... 313/141; 313/140; 123/169 EL

(58) Field of Classification Search ..... 313/140–143, 313/118; 445/7

See application file for complete search history.

(56) References Cited

U.S. PATENT DOCUMENTS

| | | | | |
|---|---|---|---|---|
| 2,489,410 | A | 11/1949 | Hahn | |
| 2,531,638 | A | 11/1950 | Miller | |
| 2,760,099 | A | 8/1956 | Suter | |
| 2,831,138 | A | 4/1958 | Teasel | |
| 2,871,389 | A | 1/1959 | Skunda | |
| 2,874,322 | A | 2/1959 | Bychinsky | |
| 3,202,859 | A | 8/1965 | Knaggs | |
| 3,229,032 | A | 1/1966 | Willis | |
| 3,394,285 | A | 7/1968 | Lindsay | |
| 3,538,372 | A | 11/1970 | Terao | |
| 3,706,897 | A | 12/1972 | Shepardson | |
| 3,958,144 | A | 5/1976 | Franks | |
| 3,988,646 | A | 10/1976 | Atkins et al. | |
| 4,374,450 | A | 2/1983 | Warren et al. | |
| 4,419,601 | A | 12/1983 | Hamai et al. | |
| 5,408,961 | A | 4/1995 | Smith | |
| 5,461,276 | A | 10/1995 | Matsutani et al. | |
| 5,892,319 | A | 4/1999 | Rossi | |
| 5,936,332 | A | 8/1999 | Krupa et al. | |
| 6,232,704 | B1 * | 5/2001 | Herweg et al. | 313/141 |
| 6,344,707 | B1 * | 2/2002 | Kibbey | 313/141 |
| 6,670,740 | B2 | 12/2003 | Landon, Jr. | |

* cited by examiner

*Primary Examiner*—Karabi Guharay
(74) *Attorney, Agent, or Firm*—McCormick, Paulding & Huber LLP

(57) ABSTRACT

A spark plug includes a sparking electrode with a firing tip, and a ground electrode having an elongated member extending outwardly from the sleeve. The elongated member has an inner surface defining a generally circular hole. The inner surface forms a circle disposed generally in a plane transverse to and having a radial center coinciding with the central axis of the insulator body, whereby each differential segment of the inner surface radially thereabout is generally equidistant to the firing tip. The inner surface is a closest portion of the ground electrode relative to the firing tip. At least a portion of the inner surface of the elongated member opposing the firing tip has a radius of curvature of about that of the firing tip for providing a spark along a path of least resistance from the firing tip to a point on the opposing inner surface of the elongated member.

19 Claims, 2 Drawing Sheets

HIGH ELECTRICAL STICTION SPARK PLUG

CROSS-REFERENCE TO RELATED APPLICATION

This application is related to my U.S. Pat. No. 6,670,740 B2, issued on Dec. 30, 2003, the disclosure of which is herein incorporated by reference in its entirety.

FIELD OF THE INVENTION

The present invention is directed generally to spark plugs, and more particularly to a high electrical stiction spark plug.

BACKGROUND OF THE INVENTION

Prior spark plugs typically provide gap electrodes that are flat and parallel or round and symmetrical (i.e., circular convex to circular concave). One such spark plug provides one or more prongs disposed over the tip of a center or sparking electrode. Such spark plugs generate a spark at the outermost tip of the center electrode which results in the gradual build-up of carbon on the tips of the central electrode and the prongs. The carbon build-up leads to a reduced capacity or failure in generating a spark for igniting the fuel/air mixture in an internal combustion engine. Further, the prongs tend to need re-gapping because of electrical use wear and any unwanted bending of the prongs which can occur during periodic cleaning of the spark plug electrodes.

In order to lengthen operational life, another type of spark plug has a disk-like terminal head concentrically located in spaced relation within a cylindrical ground electrode to provide an annular sparking gap between the ground electrode and the entire circumference of the disk-like terminal head of the sparking electrode. Thus, in this type of spark plug, firing may occur across the annular sparking gap anywhere along its circumferential length and therefore less fouling will occur as compared with spark plugs having a single point-to-point contact between a central electrode and a ground electrode prong. A drawback with spark plugs with annular sparking gaps, however, is that the center electrode and insulator are typically not exposed to enough of the fuel/air mixture to prevent fouling and are susceptible to damage resulting from, for example, accidental dropping of the spark plug. Further, the insulator member of such spark plugs typically does not have enough exposure to the fuel/air mixture for allowing sufficient cooling to prevent an associated insulator heat build-up which can in turn lead to cracking or insulator resistance breakdown.

In view of the foregoing, it is a general object of the present invention to provide a spark plug which overcomes the above-mentioned drawbacks associated with the use and operational life of prior art spark plugs.

SUMMARY OF THE INVENTION

In a first aspect of the present invention, a spark plug comprises an elongated electrical insulator body defining a first bore extending longitudinally along a central axis of the body from a connector end to a firing end. A sparking electrode communicates with the first bore. The sparking electrode includes a firing tip defining a convex outer surface generally having a radius of curvature. The firing tip has an outermost point generally coinciding with the central axis. A ground electrode includes a sleeve adjacent to the firing tip of the sparking electrode. The sleeve defines a second bore accommodating at least a longitudinal end portion of the insulator body adjacent to its firing end. The ground electrode further includes an elongated member extending outwardly from the sleeve. The elongated member has an inner surface defining a generally circular hole. The inner surface forms a circle disposed generally in a plane transverse to and having a radial center coinciding with the central axis of the insulator body, whereby each differential segment of the inner surface radially thereabout is generally equidistant to the firing tip. The inner surface is a closest portion of the ground electrode relative to the firing tip. At least a portion of the inner surface of the elongated member opposing the firing tip has a radius of curvature of about that of the firing tip for providing a spark along a path of least resistance from the firing tip of the sparking electrode to a point of contact on the opposing inner surface defined by the elongated member of the ground electrode.

In a second aspect of the present invention, a spark plug comprises an elongated electrical insulator body defining a first bore extending longitudinally along a central axis of the body from a connector end to a firing end. A sparking electrode communicates with the first bore. The sparking electrode includes a firing tip defining a convex outer surface generally having a radius of curvature. The firing tip has an outermost point generally coinciding with the central axis. A ground electrode includes a sleeve adjacent to the firing tip of the sparking electrode. The sleeve defines a second bore accommodating at least a longitudinal end portion of the insulator body adjacent to its firing end. The ground electrode further includes an elongated member extending outwardly from the sleeve. The elongated member includes two support portions extending generally outwardly from the sleeve toward the firing end. The elongated member also includes a bridge portion extending between the support portions. The bridge portion has an inner surface defining a generally circular hole. The inner surface forms a circle disposed generally in a plane transverse to and having a radial center coinciding with the central axis of the insulator body, whereby each differential segment of the inner surface radially thereabout is generally equidistant to the firing tip. The inner surface is a closest portion of the ground electrode relative to the firing tip. At least a portion of the inner surface of the bridge portion opposing the firing tip has a radius of curvature of about that of the firing tip for providing a spark along a path of least resistance from the firing tip of the sparking electrode to a point of contact on the opposing inner surface defined by the bridge portion.

In a third aspect of the present invention, a spark plug comprises an elongated electrical insulator body defining a first bore extending longitudinally along a central axis of the body from a connector end to a firing end. A sparking electrode communicates with the first bore. The sparking electrode includes a firing tip defining a convex outer surface generally having a radius of curvature. The firing tip has an outermost point generally coinciding with the central axis. A ground electrode includes a sleeve adjacent to the firing tip of the sparking electrode. The sleeve defines a second bore accommodating at least a longitudinal end portion of the insulator body adjacent to its firing end. An elongated member extends outwardly from the sleeve. The elongated member includes two support portions extending generally outwardly from the sleeve toward the firing end. The elongated member further includes a bridge portion extending between the support portions. The bridge portion has an inner surface defining a generally circular hole. The inner surface forms a circle disposed generally in a plane transverse to and having a radial center coinciding with the central axis of the insulator body, whereby each differential segment of the inner surface radially thereabout is generally equidistant to the firing tip. The inner surface is a closest portion of the ground electrode relative to the firing tip. At least a portion of the inner surface of the bridge portion opposing the firing tip has a radius of curvature of about that of the firing tip for providing a spark along a path of least resistance from the firing tip of the sparking electrode to a point of contact on the opposing inner surface defined by the bridge portion. The elongated member also includes a cylindrical member disposed between the sleeve and the elongated member.

One advantage of the present invention is that the spark gap between electrodes need be set only once during the manufacture of the spark plug.

Another advantage of the present invention is that the ground electrode forms a cage or enclosure which protects the firing tip of the sparking electrode and the insulator body from mechanical damage resulting from, for example, accidentally dropping the spark plug.

A further advantage of the present invention is that the spark plug provides a plurality of generally radial spark paths which significantly extends the operational life of the spark plug.

DETAILED DESCRIPTION OF THE PREFERRED EMBODIMENTS

Figure 1:
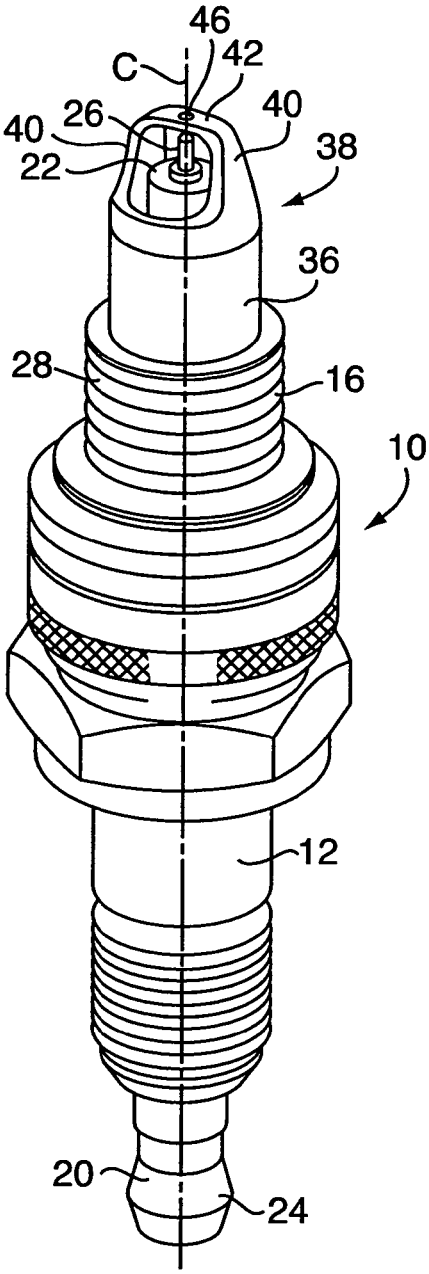
FIG. 1 is a perspective view of a spark plug embodying the present invention.
Figure 2:
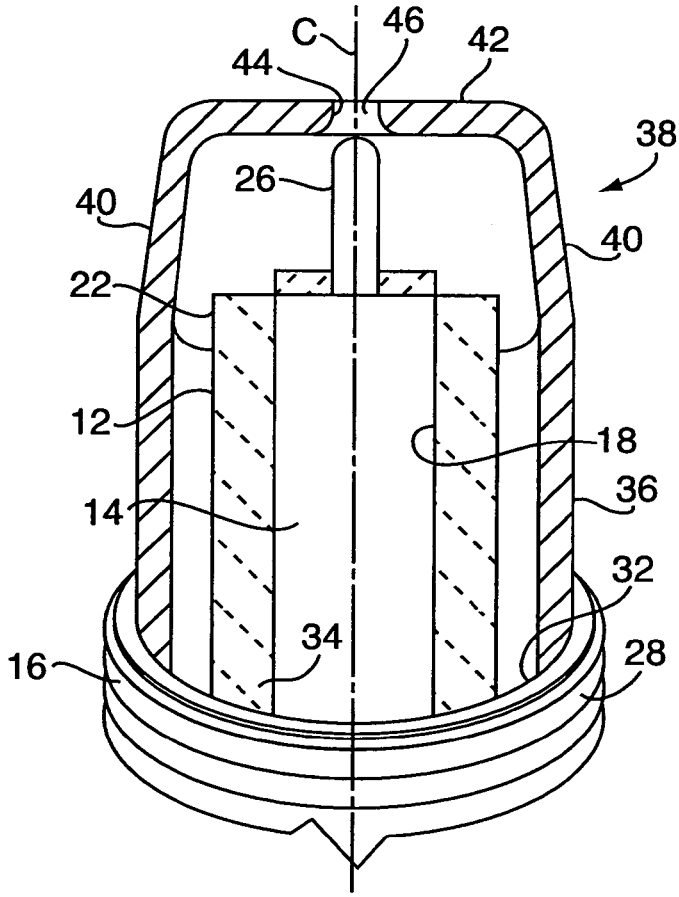
FIG. 2 is a partial cross-sectional view of the firing end of the spark plug of FIG. 1.

With reference to FIGS. 1 and 2, a spark plug embodying the present invention is indicated generally by the reference number 10. The spark plug includes an elongated electrical insulator body 12, a sparking electrode 14 and a ground electrode 16.

The insulator body 12, preferably a ceramic material, defines a first bore 18 extending longitudinally along a central axis C of the insulator body from a connector end 20 to a firing end 22 of the insulator body. The sparking electrode 14 has a terminal end 24 at the connector end 20 of the insulator body 12, and at an opposite end an exposed firing tip 26. The firing tip 26 defines a convex outer surface generally having a radius of curvature and extends slightly outwardly from the firing end 22 of the insulator body 12 to provide maximum resistance to spark bleed off before spark firing, and to protect the insulator body 12 from damaging effects of the ignition of a fuel/air mixture in an internal combustion engine (not shown). As shown in FIGS. 1 and 2, the convex outer surface of the firing tip 26, preferably of a platinum material, faces generally away from the connector end 20 of the insulator body 12. The sparking electrode 14 is substantially disposed within the first bore 18 such that the terminal end 24 extends slightly longitudinally outwardly from the connector end 20 of the insulator body 12 for connection to the boot of a spark plug cable (not shown), and the firing tip 26 extends slightly longitudinally outwardly from the firing end 22 of the insulator body for immersion in a fuel/air mixture in a firing chamber of an internal combustion engine. As shown in FIG. 2, the center of the firing tip 26 of the sparking electrode 14 coincides with the central axis C of the insulator body 12.

The ground electrode 16 includes a sleeve 28 positioned adjacent to the firing tip 26 of the sparking electrode 14. The sleeve 28 defines an external threaded surface for being threadably received in the cylinder head of an internal combustion engine (not shown), and defines a second bore 32 accommodating at least a longitudinal end portion 34 of the insulator body 12 adjacent to the firing end 22. The ground electrode 16 further includes a cylindrical portion 36 extending outwardly from the sleeve 28 toward the firing end 22. The cylindrical portion 36 can be as thin as a washer or a long as required to provide deep plug penetration for proper ignition spark. As shown in FIG. 1, the cylindrical portion 36 extends about at least a portion of the firing end 22. The ground electrode 16 also includes an elongated member generally indicated by the reference number 38 extending outwardly from the sleeve 28. In an exemplary embodiment as shown in FIGS. 1 and 2, the elongated member 38 includes two support portions 40 extending generally outwardly from the sleeve 28 toward the firing end 22, and a bridge portion 42 extending between the support portions. The bridge portion 42 has an inner surface 44, preferably of a platinum material, defining a generally circular hole 46 fabricated, for example, by drilling. The inner surface 44 forms a circle disposed generally in a plane transverse to and having a radial center coinciding with the central axis C of the insulator body 12, whereby each differential segment of the inner surface radially thereabout is generally equidistant to the firing tip 26. The inner surface 44 is a closest portion of the ground electrode 16 relative to the firing tip 26. At least a portion of the inner surface 44 of the bridge portion 42 of the elongated member 38 facing the firing tip is convex and has a radius of curvature of about that of the firing tip, to thereby provide a spark path of least resistance from the firing tip of the sparking electrode 14 to a point of contact on the opposing inner surface of the ground electrode 16. It has been discovered that the firing tip 26 when in the form of a dome or half-sphere, and the inner surface 44 of the bridge portion 42 both having a similar radius of curvature cooperate to provide inherent maximum electrical stiction (i.e., allows equivalent ball to ball spark firing) to prevent spark bleed off before a spark fires so that maximum spark enhancement (i.e., hottest spark) occurs.

As shown in FIGS. 1 and 2, the inner surface 44 of the bridge portion 42 forms an annular curve disposed generally in a plane transverse to and having a radial center coinciding with the central axis C of the insulator body 12 such that each differential segment of the inner surface radially thereabout is generally equidistant to the firing tip 26. As a result, a spark path can be terminated at any point radially about the inner surface 44. Further, the inner surface 44 is disposed longitudinally adjacent to, and more specifically as shown in FIGS. 1 and 2, slightly longitudinally outwardly from the firing tip 26 of the sparking electrode 14 such that the cylindrical portion 36, the support portions 40 and the bridge portion 42 cooperate to form a cage or vented enclosure that resembles a tapered handle with a cylindrical body. Preferably, the cylindrical portion 36, the support portions 40 and the bridge portion 42 are of unitary construction, but may be separate components coupled to one another without departing from the scope of the present invention. The cylindrical portion 36 is either pressed, screwed or welded into the second bore 32 or coupled by the same means to an outer bore of a further reduced component (not shown) disposed between the cylindrical portion and the sleeve 28. The cylindrical portion 36 can be removably attached, for example by a flange and screw collet, within the second bore 32 so that the elongated member 38 of the ground electrode 16 can be easily switched or replaced, and is easy to spark plug gap and store in stock. The vented enclosure about the firing tip 26 allows the pre-explosion fuel/air mixture to sufficiently cool the spark plug insulator end to eliminate hot spot problems (i.e., cracking the insulator) associated with conventional radially directed spark plugs. The vented enclosure also creates an additional fuel/air mixture explosion wind around the firing tip 26 and the elongated member 38 to substantially prevent carbon build-up on the tip and the inner surface 44 of the bridge portion 42 of the elongated member 38. Moreover, the enclosure protects the firing tip 26 of the sparking electrode 14 and the insulator body 12 from mechanical damage resulting from, for example, accidentally dropping the spark plug.

In operation, when a spark is generated between the electrodes 14 and 16, it extends along a path of least resistance. The path of least resistance is generally the shortest path between the firing tip 26 of the sparking electrode 14 and the ground electrode 16. As shown in FIGS. 1 and 2, the shortest distance generally is between a point of contact from a side portion circumferentially about the dome of the firing tip 26 and a point of contact radially about the inner surface 44 of the bridge portion 42 of the elongated member 38 from the portion of the inner surface facing the firing tip. As mentioned above, a spark path has a termination point at a side portion of the dome of the firing tip 26 because the side portion is closer to the inner surface 44 relative to the outermost point of the dome coinciding with the central axis C.

The exact termination points of a spark path at a first end radially about the dome and at a second end radially about the inner surface 44 of the bridge portion 42 of the elongated member 38 are determined by a variety of factors including fuel fluctuations and slight point-to-point variations in distance between the firing tip 26 and the inner surface. For example, if a contact point for a spark on the inner surface 44 deteriorates because of electrical spark contact corrosion (pitting), the spark gap will slightly increase which slightly lowers conductivity at this point. As a result, the path of least resistance now may be at another point on the inner surface 44 that has not yet been contacted by a spark.

The provision of a plurality of contact points for each end of a spark path significantly extends the operational life of the spark plug 10. Because the spark plug 10, in effect, supplies new contact points, regapping which is common for conventional spark plugs using point-to-point electrodes is not necessary with the spark plug embodying the present invention. The gap between the firing tip 26 of the sparking electrode 14 and the inner surface 44 of the ground electrode 16 need be set only once during manufacture, and such factory setting of the gap is sufficient for the operational life of the spark plug 10.

Figure 3:
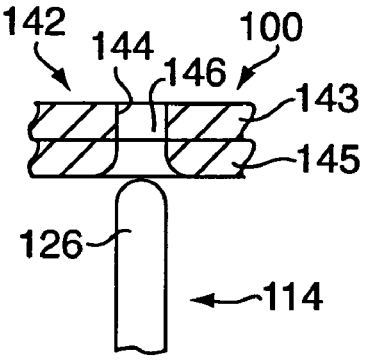
FIG. 3 is a partial cross-sectional view of the firing end of a spark plug in accordance with a second embodiment of the present invention.

FIG. 3 is a partial cross-sectional view of the firing end of a spark plug 100 in accordance with a second embodiment of the present invention. Like elements with the spark plug 10 of FIGS. 1 and 2 are designated by like reference numbers preceded by "1".

A bridge portion 142 of a ground electrode is similar to the bridge portion 42 of FIGS. 1 and 2, except that the bridge portion 142 includes an upper layer 143 extending between support portions, and a lower layer or anvil 145 disposed beneath and abutting an undersurface of the bridge portion. The lower layer 145 is preferably coupled to the upper layer 143 by, for example, welding or press fitting between the support portions. The upper layer 143 and the lower layer 145 cooperate to define an inner surface 144 forming a generally circular hole 146. At least a portion of the inner surface 144 formed by the lower layer 145 facing the firing tip 126 is convex and has a radius of curvature of about that of the firing tip, for providing a spark along a path of least resistance from the firing tip of the sparking electrode 114 to a point of contact on the opposing inner surface defined by the bridge portion 142 of the ground electrode. Preferably, the lower layer 145 is annular in shape so as to resemble a washer, but may take other shapes without departing from the scope of the present invention.

Figure 4:
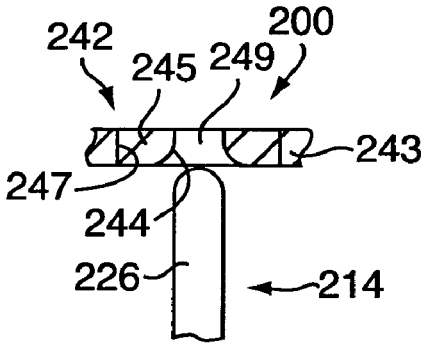
FIG. 4 is a partial cross-sectional view of the firing end of a spark plug in accordance with a third embodiment of the present invention.

FIG. 4 is a partial cross-sectional view of the firing end of a spark plug 200 in accordance with a third embodiment of the present invention. Like elements with the spark plug 10 of FIGS. 1 and 2 are designated by like reference numbers preceded by "2".

A bridge portion 242 of a ground electrode is similar to the bridge portion 42 of FIGS. 1 and 2, except that the bridge portion 242 includes a radially outer portion 243 and a radially inward portion or anvil 245. The radially inward portion 245 is disposed within a hole 247 defined by the outer portion 243 and secured therein by, for example, press fitting. The inward portion 245 defines an inner surface 244 forming a generally circular hole 249. At least a portion of the inner surface 244 formed by the inward portion 245 facing the firing tip 226 has a radius of curvature of about that of the firing tip, for providing a spark along a path of least resistance from the firing tip of the sparking electrode 214 to a point of contact on the opposing inner surface defined by the inward portion 245 of the ground electrode.

Figure 5:
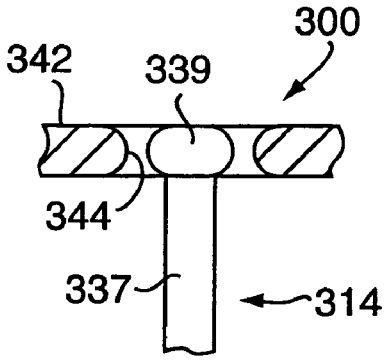
FIG. 5 is a partial cross-sectional view of the firing end of a spark plug in accordance with a fourth embodiment of the present invention.

FIG. 5 is a partial cross-sectional view of the firing end of a spark plug 300 in accordance with a fourth embodiment of the present invention. Like elements with the spark plug 10 of FIGS. 1 and 2 are designated by like reference numbers preceded by "3".

A firing tip of a sparking electrode 314 includes a base portion 337 and a ring or annular member 339 coupled to an end of the base portion by, for example, press fitting or tooling. The annular member 339 of the firing tip has a radius of curvature that is generally the same across the spark plug radial gap as the radius of curvature of an inner surface 344 defined by a bridge portion 342 of a ground electrode.

Although this invention has been shown and described with respect to exemplary embodiments thereof, it should be understood by those skilled in the art that the foregoing and various other changes, omissions and additions in the form and detail thereof may be made therein without departing from the spirit and scope of the invention. Accordingly, the present invention has been shown and described by way of illustration rather than limitation.

What is claimed is:

1. A spark plug comprising:

an elongated electrical insulator body defining a first bore extending longitudinally along a central axis of the body from a connector end to a firing end;

a sparking electrode communicating with the first bore, the sparking electrode including a firing tip defining a convex outer surface generally having a radius of curvature, the firing tip having an outermost point generally coinciding with the central axis; and a ground electrode including a sleeve adjacent to the firing tip of the sparking electrode, the sleeve defining a second bore accommodating at least a longitudinal end portion of the insulator body adjacent to the firing end, the ground electrode further including an elongated member extending outwardly from the sleeve, the elongated member having an inner surface extending between an upper surface and a lower surface of the elongated member, the inner surface defining a generally circular hole, the inner surface forming a circle disposed generally in a plane transverse to and having a radial center coinciding with the central axis of the insulator body, whereby each differential segment of the inner surface radially thereabout is generally equidistant to the firing tip, the inner surface being a closest portion of the ground electrode relative to the firing tip, and at least a portion of the inner surface of the elongated member opposing the firing tip having a radius of curvature of about that of the firing tip for providing a spark along a path of least resistance from the firing tip of the sparking electrode to a point of contact on the opposing inner surface defined by the elongated member of the ground electrode.

2. A spark plug as defined in claim 1, wherein the convex outer surface of the firing tip faces generally away from the connector end of the electrical insulator body.

3. A spark plug as defined in claim 1, wherein the inner surface of the elongated member is disposed slightly outwardly from the firing tip of the sparking electrode.

4. A spark plug as defined in claim 1, wherein the elongated member includes two support portions extending generally outwardly from the sleeve toward the firing end, and a bridge portion extending between the support portions, the bridge portion defining the inner surface of the elongated member.

5. A spark plug as defined in claim 4, wherein the support portions each taper inwardly toward the central axis in a direction from the connector end to the firing end.

6. A spark plug as defined in claim 5, wherein the ground electrode further includes a cylindrical member disposed between the sleeve and the elongated member.

7. A spark plug as defined in claim 6, wherein the bridge portion is disposed slightly longitudinally outwardly from the firing tip of the sparking electrode such that the cylindrical member, the support portions and the bridge portion cooperate to form a protective cage for the firing tip of the sparking electrode.

8. A spark plug as defined in claim 1, wherein the filling up of the sparking electrode forms a dome at least partly covering the firing end of the insulator body, whereby a spark has a point of contact on any side portion of the dome.

9. A spark plug as defined in claim 1, wherein the firing tip of the sparking electrode forms a half-sphere at least partly covering the firing end of the insulator body, whereby a spark has a point of contact on arty side portion of the half-sphere.

10. A spark plug comprising:

an elongated electrical insulator body defining a first bore extending longitudinally along a central axis of the body from a connector end to a firing end;

a sparking electrode communicating with the first bore, the sparking electrode including a firing tip defining a convex outer surface generally having a radius of curvature, the firing tip having an outermost point generally coinciding with the central axis; and a ground electrode including a sleeve adjacent to the firing tip of the sparking electrode, the sleeve defining a second bore accommodating at least a longitudinal end portion of the insulator body adjacent to the firing end, the ground electrode further including an elongated member extending outwardly from the sleeve, the elongated member including two support portions disposed at radially opposite ends of the sleeve relative to each other and extending generally outwardly from the sleeve toward the firing end, and the elongated member including a generally rectangularly shaped bridge portion extending between the support portions, the bridge portion having an inner surface extending between an upper surface and a lower surface of the bridge portion of the inner surface defining a generally circular hole, the inner surface forming a circle disposed generally in a plane transverse to and having a radial center coinciding with the central axis of the insulator body, whereby each differential segment of the inner surface radially thereabout is generally equidistant to the firing tip, the inner surface being a closest portion of the ground electrode relative to the firing tip, and at least a portion of the inner surface of the bridge portion opposing the firing tip having a radius of curvature of about that of the firing tip for providing a spark along a path of least resistance train the firing tip of the sparking electrode to a point of contact on the opposing inner surface defined by the bridge portion.

11. A spark plug as defined in claim 10, wherein the convex outer surface of the firing tip faces generally away from the connector end of the electrical insulator body.

12. A spark plug as defined in claim 10, wherein the inner surface of the bridge portion is disposed slightly longitudinally outwardly from the firing tip of the sparking electrode.

13. A spark plug as defined in claim 10, wherein the support portions each taper inwardly toward the central axis in a direction from the connector end to the firing end.

14. A spark plug as defined in claim 10, wherein the ground electrode further includes a cylindrical member disposed between the sleeve and the elongated member.

15. A spark plug as defined in claim 14, wherein the bridge portion is disposed longitudinally outwardly from the firing tip of the sparking electrode such that the cylindrical member, the support portions and the bridge portion cooperate to form a protective cage for the firing tip of the sparking electrode.

16. A spark plug as defined in claim 10, wherein the firing tip of the sparking electrode forms a dome at least partly covering the firing end of die insulator body, whereby a spark has a point of contact on any side portion of the dome.

17. A spark plug as defined in claim 10, wherein the firing tip of the sparking electrode forms a half-sphere at least partly covering the firing end of the insulator body, whereby a spark has a point of contact on any side portion of the half-sphere.

18. A spark plug comprising:

an elongated electrical insulator body defining a first bore extending longitudinally along a central axis of the body from a connector end to a firing end;

a sparking electrode communicating with the first bore, the sparking electrode including a firing tip defining a convex outer surface generally having a radius of curvature, the firing tip having an outermost point generally coinciding with the central axis; and a ground electrode including:

a sleeve adjacent to the firing tip of the sparking electrode, the sleeve defining a second bore accommodating at least a longitudinal end portion of the insulator body adjacent to the firing end;

an elongated member extending outwardly from the sleeve, the elongated member including two support portions disposed at radially opposite ends relative to each other and extending generally outwardly from the sleeve toward the firing end;

a generally rectangularly shaped bridge portion extending between the support portions, the bridge portion having an inner surface extending between an upper surface and a lower surface of the bridge portion, the inner surface defining a generally circular hole, the inner surface forming a circle disposed generally in a plane transverse to and having a radial center coinciding with the central axis of the insulator body, whereby each differential segment of the inner surface radially thereabout is generally equidistant to the firing tip, the inner surface being a closest portion of the ground electrode relative to the firing tip, and at least a portion of the inner surface of the bridge portion opposing the firing tip having a radius of curvature of about that of the firing tip for providing a spark along a path of least resistance from the firing tip of the sparking electrode to a point of contact on the opposing inner surface defined by the bridge portion; and a cylindrical member disposed between the sleeve and the elongated member.

19. A spark plug as defined in claim 18, wherein the bridge portion is disposed slightly longitudinally outwardly from the firing tip of the sparking electrode such that the cylindrical member, the support portions and the bridge portion cooperate to form a protective cage for the firing tip of the sparking electrode.

* * * * *

UNITED STATES PATENT AND TRADEMARK OFFICE

CERTIFICATE OF CORRECTION

PATENT NO. : 7,256,533 B2
APPLICATION NO. : 10/899665
DATED : August 14, 2007
INVENTOR(S) : William W. Landon, Jr.

It is certified that error appears in the above-identified patent and that said Letters Patent is hereby corrected as shown below:

Col. 7, line 28, --longitudinally-- should be inserted after "slightly"

Col. 7, lines 48-49, delete the words "filling up" and replace them with the words --firing tip--

Col. 7, line 55, delete the word "arty" and replace it with the word --any--

Col. 8, line 40, --slightly-- should be inserted before "longitudinally"

Col. 8, line 47, delete the word "die" and replace it with the word --the--.

Signed and Sealed this

Thirtieth Day of October, 2007

JON W. DUDAS
*Director of the United States Patent and Trademark Office*